US010299548B1

(12) United States Patent
Belock

(10) Patent No.: US 10,299,548 B1
(45) Date of Patent: May 28, 2019

(54) ADVANCED ADJUSTABLE FINGER RING APPARATUS AND METHODS

(71) Applicant: John F. Belock, Oro Valley, AZ (US)

(72) Inventor: John F. Belock, Oro Valley, AZ (US)

( * ) Notice: Subject to any disclaimer, the term of this patent is extended or adjusted under 35 U.S.C. 154(b) by 0 days.

(21) Appl. No.: 15/679,007

(22) Filed: Aug. 16, 2017

Related U.S. Application Data

(60) Continuation of application No. 14/942,688, filed on Nov. 16, 2015, now Pat. No. 9,743,726, which is a division of application No. 14/280,485, filed on May 16, 2014, now abandoned.

(60) Provisional application No. 61/825,071, filed on May 19, 2013.

(51) Int. Cl.
*A44C 9/02* (2006.01)
*A44C 27/00* (2006.01)

(52) U.S. Cl.
CPC ..... *A44C 9/02* (2013.01); *A44C 27/00* (2013.01)

(58) Field of Classification Search
CPC ..... A44C 9/00; A44C 9/02
See application file for complete search history.

(56) References Cited

U.S. PATENT DOCUMENTS

| | | | |
|---|---|---|---|
| 263,920 | A | 9/1882 | La Grange |
| 299,962 | A | 6/1884 | Combs |
| 1,075,673 | A | 10/1913 | Segman |
| 1,219,172 | A | 3/1917 | Segman |
| 2,392,210 | A | 1/1946 | Zaleske |
| 2,503,223 | A | 4/1950 | Stade |
| 4,223,541 | A | 9/1980 | Martinez |
| 4,261,185 | A | 4/1981 | Martinez |
| 5,415,064 | A | 5/1995 | Chang |
| 5,636,531 | A | 6/1997 | Miller |
| 6,003,334 | A | 12/1999 | Miller |
| 6,029,548 | A | 2/2000 | Hsieh |
| 6,240,814 | B1 | 6/2001 | Boyd |

*Primary Examiner* — Abigail E Troy
(74) *Attorney, Agent, or Firm* — Pritzkau Patent Group, LLC

(57) ABSTRACT

An adjustable finger ring apparatus and associated method are described for forming at least a portion of a finger ring. A shank includes a thickness that extends between an opposing pair of side surfaces such that the thickness defines a cavity including a through opening for receiving the support member for movement in opposing directions to increase and decrease the size of a finger aperture. At least one of the side surfaces defines an access opening to adjoin the through opening for access to the support member for at least one of moving the support member and maintaining a selected position of the support member.

10 Claims, 4 Drawing Sheets

ADVANCED ADJUSTABLE FINGER RING APPARATUS AND METHODS

RELATED APPLICATION

This application is a continuation application of copending U.S. patent application Ser. No. 14/942,688 filed Nov. 16, 2015, which is a divisional application of U.S. patent application Ser. No. 14/280,485 filed May 16, 2014, which claims priority from U.S. Provisional Patent Application Ser. No. 61/825,071 filed on May 19, 2013, each of which are incorporated herein by reference in their entirety.

BACKGROUND

The present application is generally related to finger rings and, more particularly, to advanced adjustable finger ring apparatus and methods.

The prior art includes a number of examples of finger ring adjustment devices. Such devices are generally needed when a wearer has an enlarged knuckle such that the ring can pass over the enlarged knuckle to be received on a digital portion of the finger. Prior art attempts to provide finger ring adjustment devices can be seen, for example, in U.S. Pat. Nos. 5,636,531 and 6,003,334 by Miller (hereinafter, the Miller patents). Applicants recognize, however, that the approaches taken in the Miller patents and the prior art, in general, can involve relatively complex and fragile mechanisms that can be difficult to actuate, particularly by a wearer experiencing conditions such as, for example, arthritis. The present application provides heretofore unseen approaches that are submitted to resolve the limitations of prior art approaches.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one aspect of the disclosure, embodiments of an adjustable finger ring apparatus and associated methods are described for forming at least a portion of a finger ring. A finger pad is configured for engaging the finger of a wearer. A support member includes an elongated length extending from the finger pad. A shank includes an inner periphery for at least partially defining a finger aperture of the finger ring. The shank includes a thickness that extends between an opposing pair of side surfaces that are at least generally transverse to the inner periphery, and the thickness defines a cavity including (i) a through opening for receiving the support member such that movement of the support member in a first direction moves the finger pad to decrease the size of the finger aperture and movement of the support member in a second, opposite direction moves the finger pad to increase the size of the finger aperture and (ii) at least one of the side surfaces defines an access opening extending from the side surface to adjoin the through opening for access to the support member for at least one of moving the support member and maintaining a selected position of the support member.

In another aspect of the disclosure, another embodiment of an adjustable finger ring apparatus and associated method are described for forming at least a portion of a finger ring. A finger pad is configured engaging the finger of a wearer with the finger pad including a pair of opposing outer ends. A support member having an elongated length extends from the finger pad between the outer ends. A shank includes an inner periphery for at least partially defining a finger aperture of the finger ring. The shank includes a thickness defining a through opening for receiving the support member such that movement of the support member in a first direction moves the finger pad to decrease the size of the finger aperture and movement of the support member in a second, opposite direction moves the finger pad to increase the size of the finger aperture and the shank further defines a recess for receiving the finger pad in a retracted position with the shank and the recess being cooperatively configured such that at least one of the opposing ends of the finger pad remains at least partially received within the recess for any position of the finger pad relative to the shank.

BRIEF DESCRIPTIONS OF THE DRAWINGS

Example embodiments are illustrated in referenced figures of the drawings. It is intended that the embodiments and figures disclosed herein are to be illustrative rather than limiting.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiment shown, but is to be accorded the widest scope consistent with the principles and features described herein including modifications and equivalents. It is noted that the drawings are not to scale and are diagrammatic in nature in a way that is thought to best illustrate features of interest. Descriptive terminology such as, for example, up, down, upper, lower, left, right, bottom, top, vertical, horizontal and the like may be used with respect to these descriptions, however, this terminology has been adopted with the intent of facilitating the reader's understanding and is not intended as being limiting.

Figure 1:
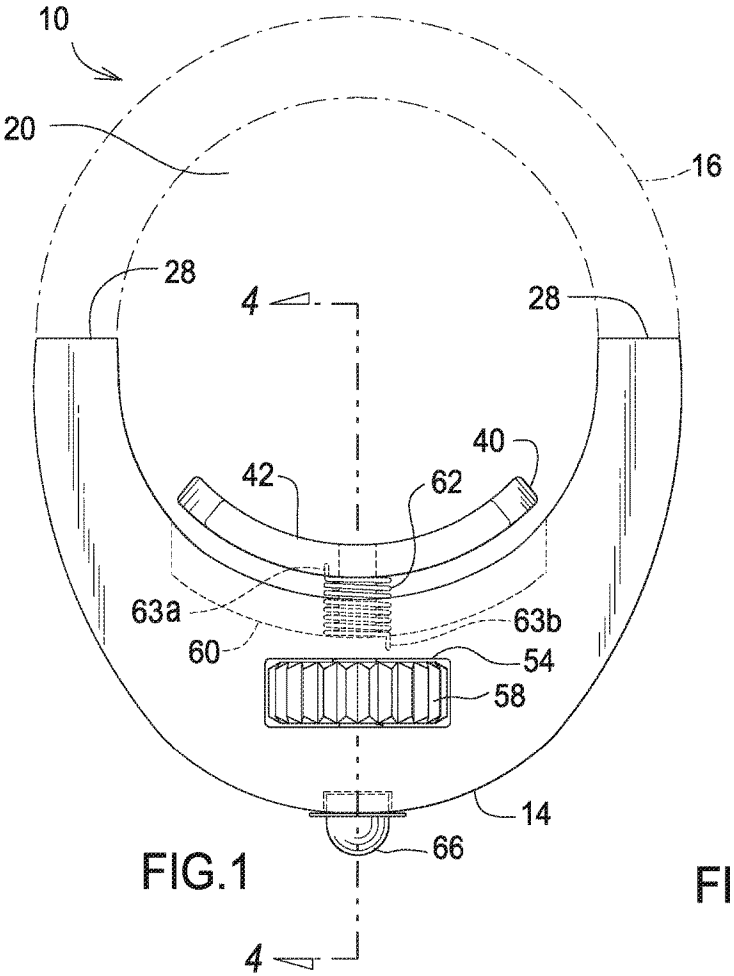
FIG. 1 is a diagrammatic view, in elevation, of an embodiment of an adjustable finger ring device in accordance with the present disclosure.
Figure 8:
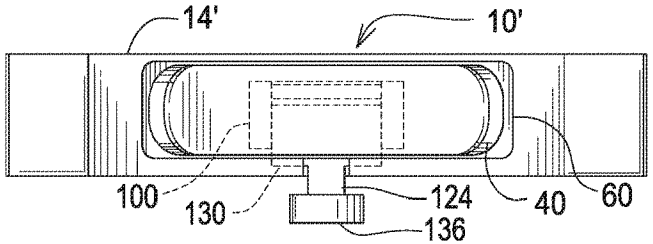
FIG. 8 is a diagrammatic top view of the embodiment of the adjustable finger ring device shown in FIG. 6.

Turning now to the figures wherein like components may be indicated by like reference numbers throughout the various views, attention is immediately directed to FIG. 1 which is an elevational view that diagrammatically illustrates an embodiment of an adjustable finger ring device that is generally indicated by the reference number 10. Device 10 can include bottom shank 14 at least as a component for use in forming an overall ring wherein the bottom shank serves as a shank insert to form a ring in cooperation with an upper shank 16 that is illustrated in phantom using dashed lines. It should be appreciated that the upper shank can support any suitable crown or crown assembly. In an embodiment, the bottom shank can be formed integrally as part of an overall ring. In either embodiment, a finger aperture 20 is defined by inner periphery of the ring that can be of any suitable shape. For example, the figure aperture can be wider vertically than horizontally, as in the view of FIG. 1. The outer periphery of the overall ring can, likewise, be of any suitable shape including but not limited to circular, oblong, elliptical, closed polygonal and suitable combinations thereof. While the bottom shank can be provided in many suitable shapes and geometries, FIG. 1 illustrates an embodiment in which the inner periphery of the ring cooperates with the outer periphery of the ring such that the width or thickness of the bottom shank progressively increases approaching a centerline 4-4. It should be appreciated that there is no requirement imposed, however, in maintaining symmetry with respect to centerline 4-4. In any case, the thickness at the centerline can be configured for purposes of accommodating the various heretofore unseen embodiments of mechanisms that have been brought to light herein. As shown in FIG. 1, upper ends 28 of bottom shank 14 define straight attachment angles. In other embodiments, upper ends 28 can be angled outward or inward, as desired. The shank can be formed from any suitable material including, but not limited to gold, silver, platinum, palladium, steel, other suitable metals, alloys and non-metallic materials.

Figure 3:
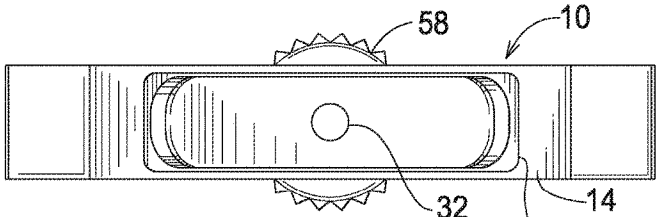
FIG. 3 is a diagrammatic top view of the embodiment of the adjustable finger ring device shown in FIG. 1.
Figure 4:
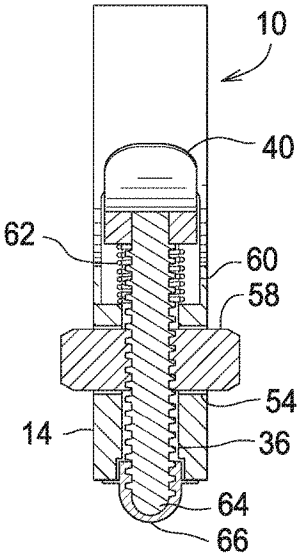
FIG. 4 is a diagrammatic, cutaway view taken along a line 4-4, shown in FIG. 1, for purposes of illustrating the internal structure of the embodiment of the adjustable finger ring device of FIG. 1.
Figure 2:
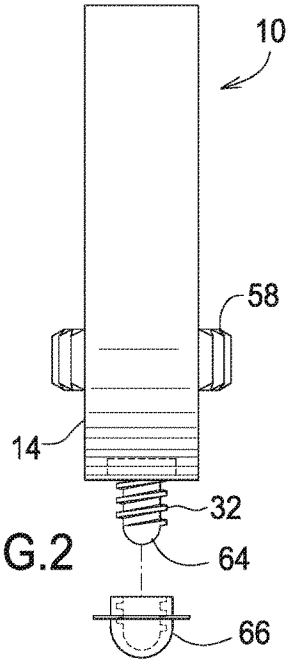
FIG. 2 is a diagrammatic side view, in elevation, of the embodiment of the adjustable finger ring device shown in FIG. 1.

Referring collectively to FIGS. 1-4, adjustable finger ring device 10 includes a post 32 that is threaded and received within an aperture 36 that is defined by bottom shank 14, as in the elevational, partially cutaway view of FIG. 4 that is taken along centerline 4-4. Such a progressive thickness increase is not required and any desired outer periphery shape can be employed. Further, it is noted that FIG. 2 provides a side elevational view of the adjustable finger ring device while FIG. 3 provides a top view. An upper end of post 32 pivotally receives a finger pad 40. The latter can be pivotally received in any suitable manner such as, for example, by riveting. In this way, the finger pad can remain stationary against the finger of a wearer as post 32 is rotated relative to the finger pad for purposes of adjusting the height of the finger pad. An upper surface 42 of the finger pad can include any suitable texture for purposes of engaging the finger of a wearer including, but not limited to a smooth finish, ribbed, a crisscross pattern, raised nubs formed at opposing ends of the finger pad, knurling, and the like. It should be appreciated that the finger pad can be jointed, hinged and/or spring loading for purposes of better conforming to the finger of the wearer as well as better conforming to the confines of a recess, yet to be described, which receives the finger pad in a lowered position. While the finger pad is illustrated as having a uniform thickness and width, no requirements are imposed with respect to these dimensions.

In another embodiment, shank 14 further defines a thumbscrew cavity 54 for receiving a thumbscrew 58 in threaded engagement with post 32. Accordingly, rotation of thumbscrew 58 provides for movement of finger pad 40 in a way that can reduce or enlarge the extents of finger aperture 20, for example, to allow the overall ring to be passed over an enlarged knuckle of the wearer and then tightened onto the digital portion of the finger. It is noted that the thumbscrew may be referred to interchangeably as a thumbnut. In embodiments that utilize a thumbscrew, post 32 can be fixedly attached to finger pad 40. In an embodiment, bottom shank 14 can define a recess 60 for at least partially receiving finger pad 40 in a lowered position. Components including finger pad 40, post 32 and thumbscrew 58 can each be formed of any suitable material such as, for example, gold, silver, platinum, palladium, steel, other suitable metals, alloys and non-metallic materials. A spring 62 such as, for example, a helical coil spring can be received by post 32. First and second end extensions 63*a* and 63*b* of the spring can be received in openings that are defined by the fingerpad and bottom shank, respectively, such that the spring serves to limit rotation of the fingerpad relative to the bottom shank. The spring is arranged such that in a home or neutral position, the finger pad is oriented as illustrated. Responsive to rotation of the finger pad in either direction relative to the shank, however, a resilient return force is applied to the finger pad to urge the finger pad back to the home position. Spring 62 can be formed from any suitable material such as, for example, steel, stainless steel, nickel and alloys thereof. In one feature, which is not required, a lowermost, outward or free end 64 of post 32 can receive a cap 66 for co-rotation with post 32. The cap can be received on the post in any suitable manner such as, for example, by threaded engagement or a pressed fit. Since cap 66 is of a diameter that is larger than the diameter of the through opening which receives post 32, the cap can limit upward travel of the finger pad (i.e., travel that reduces the size of the finger cavity) and can prevent disengagement and/or loss of finger pad 40 and post 32 responsive to over-adjustment of thumbnut 58.

Figure 5:
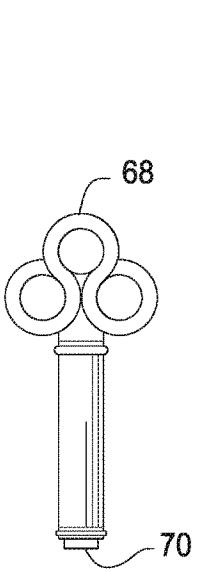
FIG. 5 is a diagrammatic view of an embodiment of a key that can be used with an embodiment of the adjustable finger ring device of FIG. 1.

In an embodiment which does not require a thumbscrew, a key 68, shown in FIG. 5, can be used to engage lowermost end 64 (FIG. 2) of post 32, wherein a distal end 70 of the key and lowermost end 64 of the post include complimentary configurations such that engaged rotation of the key causes corresponding rotation of post 32, thereby changing the extents of the finger cavity. Any suitable engagement configuration can be used including, without limitation, slotted, crossed, star and the like. Of course, the key can be provided having any suitable overall shape. In an embodiment, it should be appreciated that cavity 54 and thumbscrew 58 are not required. In this embodiment, post 32 can threadingly engage bottom shank 14 with finger pad 40 rotatably attached to the post. In the latter embodiment, spring 62 can resiliently serve to maintain the rotational orientation of the finger pad in a desired position at least generally transverse to the finger aperture. In another embodiment, key 68 can be configured to engage a complimentary configuration that is provided by cap 66. For example, cap 66 can include a hexagonal periphery.

Figure 10:
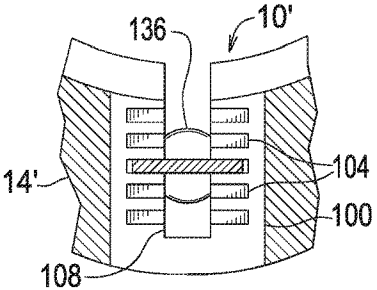
FIG. 10 is a diagrammatic fragmentary, partially cutaway view taken along a line 10-10, shown in FIG. 7, illustrating an embodiment of the appearance of an interior side wall of a through passage that can be used in the embodiment of the adjustable finger ring device of FIGS. 6 and 7, shown here to illustrate further details of its structure.
Figure 7:
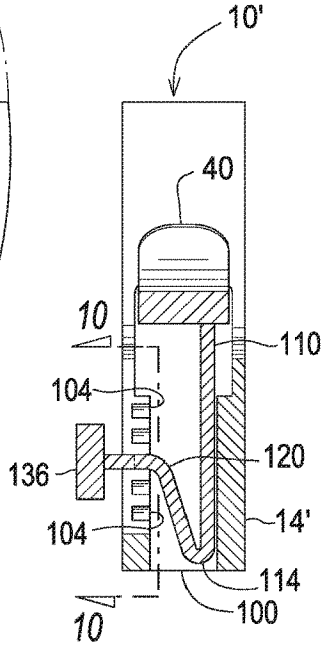
FIG. 7 is a diagrammatic, cutaway view taken along line 7-7, shown in FIG. 6, for purposes of illustrating the internal structure of the embodiment of the adjustable finger ring device of FIG. 6.
Figure 6:
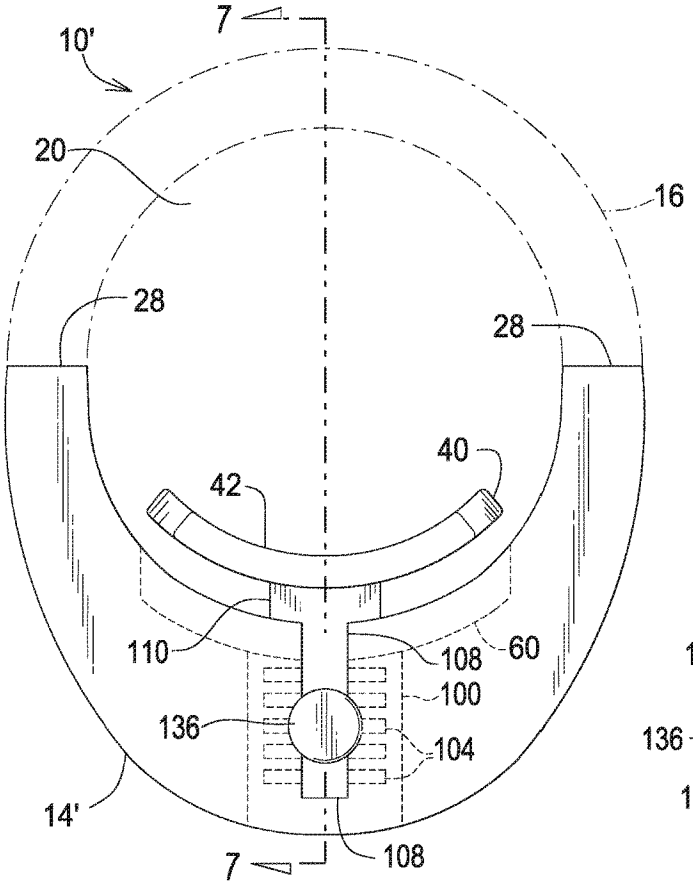
FIG. 6 is a diagrammatic view of another embodiment of an adjustable finger ring device in accordance with the present disclosure.
Figure 14:
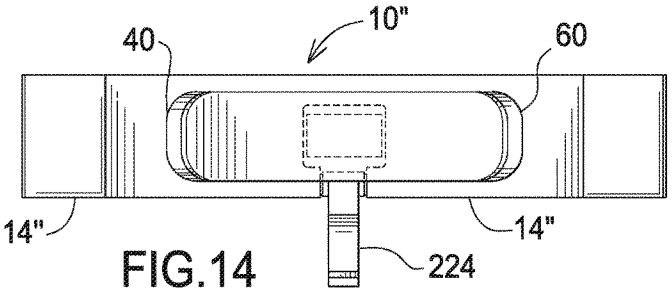
FIG. 14 is a diagrammatic top view of the embodiment of the adjustable finger ring device of FIG. 12.

Attention is now directed to FIGS. 6-10 which illustrate another embodiment of the adjustable finger ring device of the present disclosure, generally indicated by the reference number 10'. The present descriptions will be limited primarily to aspects in which the present embodiment differs from embodiment 10 of FIGS. 1-5. In this embodiment, bottom shank 14' defines a through passage 100 that extends to recess 60. A plurality of spaced apart grooves 104 (several of which are indicated) are defined in an interior sidewall of the through passage, as best seen in FIG. 10 which is taken along a line 10-10 in FIG. 7. Grooves 104 can be formed having any suitable shape and are not limited to the rectangular form that is shown. Further, a notch 108 can be defined in a face of the bottom shank such that the notch leads into through passage 100. As best seen in the view of FIG. 10, grooves 104 can extend on either side of notch 108. A resilient tongue bar 110 can be fixedly attached to finger pad 40 extending downwardly therefrom in the views of the figures. In some embodiments, the tongue bar can be integrally formed with the finger pad. The tongue bar can be formed from any suitable material that exhibits sufficient resilience based on selected dimensions including, but not limited to gold, silver, platinum, palladium, steel, other suitable metals, alloys and non-metallic materials. The tongue bar of the present embodiment defines a U-bend 114. From the U-bend, the tongue bar extends to a second bend 120 that can orient a distal end of the tongue bar such that a finger 124 (FIG. 9) extends through notch 108. Finger 124 includes a reduced width that terminates in a pair of opposing end faces 130 that are configured for resilient engagement with grooves 104 in a complementary manner. A free end of finger 124 supports a thumb pad 136 that can be fixedly attached thereto.

Having described the structure of embodiment 10' in detail, attention is now directed to its operation. For purposes of changing the position of finger pad 40, a user depresses thumb pad 136 sufficiently to disengage end faces 130 from grooves 104 and then slides tongue bar 110 such that the finger pad is moved to a desired position. Upon releasing thumb pad 136, end faces 130 can engage one of notches 104 to hold the finger pad in the desired position. Of course, a slight movement of the tongue bar along passage 100 can be needed when the thumb pad is released having the end faces misaligned with respect to grooves 104 to cause the end faces to resiliently click into an appropriate one of the grooves.

Figure 11:
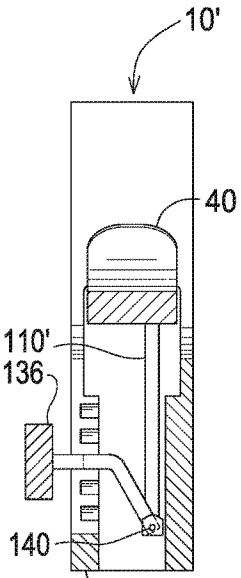
FIG. 11 is a diagrammatic, partially cutaway view illustrating the appearance of an embodiment of another resilient tongue bar that can be used in the embodiment of the adjustable finger ring device of FIG. 6.
Figure 9:
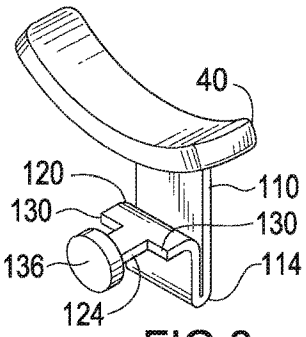
FIG. 9 is a diagrammatic view of an embodiment of a resilient tongue bar and associated components that are used in conjunction with the embodiment of the adjustable finger ring device of FIG. 6.

FIG. 11 illustrates another embodiment of the tongue bar designated by the reference number 110'. In this embodiment, U-bend 114 is replaced by a hinge 140 that can be spring loaded to provide for resilient biasing, as described above.

Figure 15:
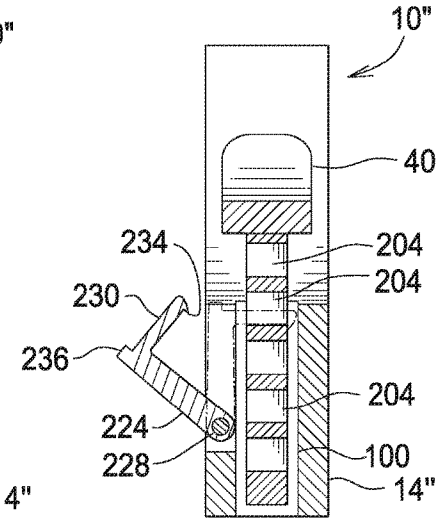
FIG. 15 is a diagrammatic, cutaway view taken along a line 15-15, shown in FIG. 12, illustrating further details of the structure of the embodiment of the adjustable finger ring device of FIG. 12.
Figure 13:
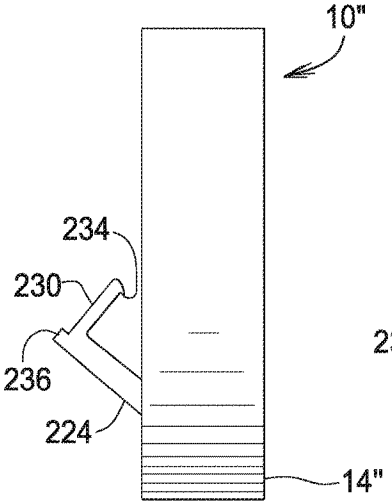
FIG. 13 is a diagrammatic view, in elevation, of the embodiment of the adjustable finger ring device of FIG. 12.
Figure 12:
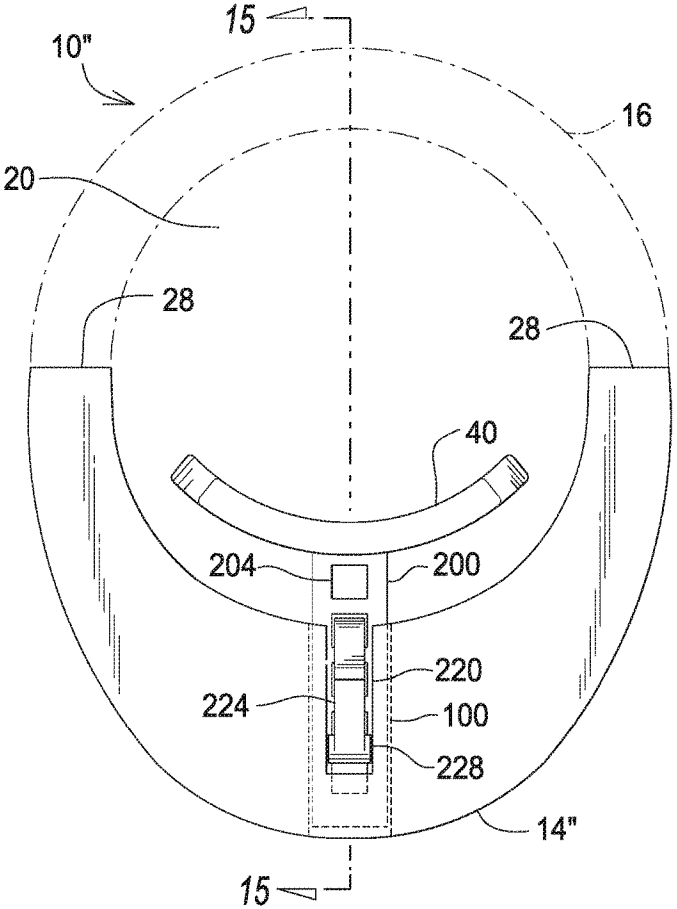
FIG. 12 is a diagrammatic view of still another embodiment of an adjustable finger ring device in accordance with the present disclosure.

Turning now to FIGS. 12-15 another embodiment of the adjustable finger ring device of the present disclosure is illustrated, generally indicated by the reference number 10". The present descriptions will be limited primarily to aspects in which the present embodiment differs from embodiments 10 and 10', described above. In this embodiment, a stepladder bar 200 extends from finger pad 40. The stepladder bar can be integrally formed with the finger pad or separately formed and fixedly attached to finger pad in any suitable manner. Suitable materials for the stepladder pad include, but are not limited to gold, silver, platinum, palladium, steel, other suitable metals, alloys and non-metallic materials. Stepladder bar 200 defines a plurality of spaced apart passages 204 along its length as best seen in the view of FIG. 15 which is a partially cutaway view of bottom shank 14" that is taken along a line 15-15 in FIG. 12. It is noted that notches 204 are illustrated having a rectangular shape, however, any suitable shape can be utilized. A front face of the bottom shank can define a pocket 220 that can lead into passage 100. A catch 224 is pivotally mounted at a pivot position 228, for example, using a pivot pin that can extend across pocket 220. The pivot pin can be received in any suitable manner such as, for example, using spring loading to engage opposing apertures at either side of the pocket. A catch bar 230 leads to a hook 234 at a distal end of the catch. During use, stepladder bar 200 is moved to a desired position at which time catch 224 is pivotally rotated such that catch bar 230 passes through one of notches 204 to snap into position whereby hook 234 engages an opposite surface of the stepladder bar. A tab 236 can be provided for purposes of convenient disengagement of the mechanism. It is noted that, in one feature, previously described recess 60 can be used by embodiment 10". Catch 224 can be formed from any suitable material including, but not limited to gold, silver, platinum, palladium, steel, other suitable metals, alloys and non-metallic materials and configured such that the catch bar exhibits sufficient resiliency for purposes of engaging the stepladder bar.

Referring generally to FIGS. 12-15, in another embodiment, catch 224 and related features can be lowered within bottom shank 14" and/or the periphery of finger aperture 20 can be changed such that recess 60 can fully receive finger pad 40 in its lowermost position. In still another embodiment, catch 224 can be modified in any suitable manner for purposes of engaging stepladder bar 200. It is noted that catch 224 is shown in phantom in FIG. 15 in the engaged position using dashed lines. In this instance, the bottom surface of finger pad 40 can engage the inner periphery of bottom shank 14" when the finger pad is fully lowered. In yet another embodiment, catch bar 230 can be extended so as to extend through bottom shank 14" such that hook 234 can engage the opposing face of the bottom shank. In one feature, the opposing face can define a cooperating recess for engaging hook 234 such that the catch bar does not extend beyond the plane of the opposing face when in the latched position. In still another embodiment, pivot position 228 can be provided, for example, between an opposing pair of flanges that are fixedly supported by the front face of bottom shank 14". In this embodiment, catch 224 is externally hinged such that pocket 220 is not required. That is, the bottom shank need only be configured to allow passage for catch bar 230 to appropriately engage stepladder bar 200.

Figure 17:
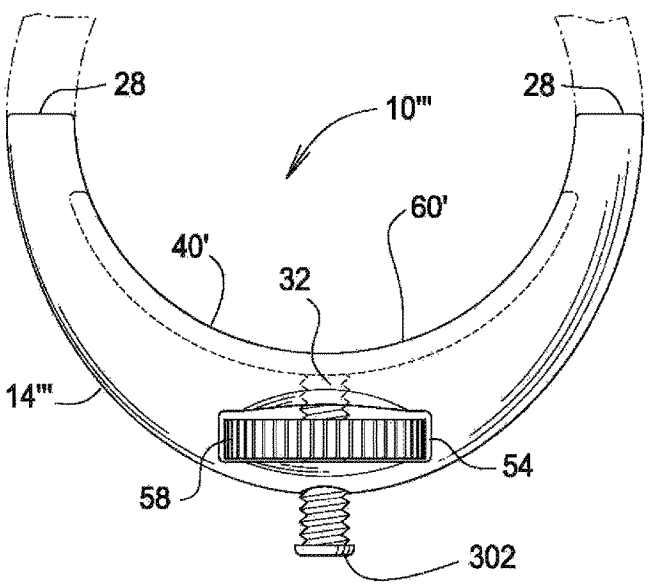
FIGS. 16 and 17 are diagrammatic views, in elevation, of another embodiment of an adjustable finger ring device in accordance with the present disclosure.
Figure 16:
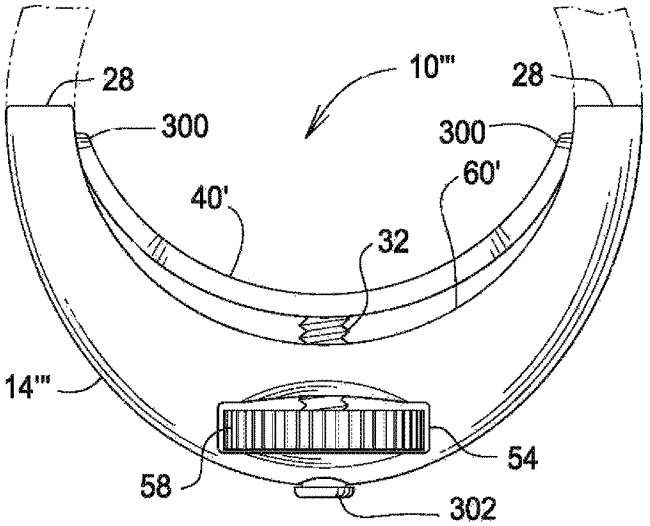
Figure 18:
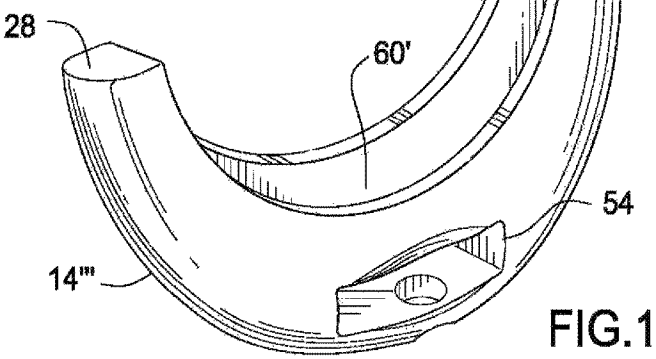
FIG. 18 is a diagrammatic view, in perspective, of the bottom shank that forms part of the adjustable finger ring device of FIGS. 16 and 17, shown here to illustrate further details of its structure.

Referring to FIGS. 16-18, another embodiment of the bottom shank is illustrated and referred to by the reference number 14'". FIG. 16 is an elevational view that illustrates a finger pad 40' in a retracted position received essentially completely within a recess 60' while FIG. 17 is another elevational view that illustrates finger pad 40' in a raised position for purposes of engaging the finger of a wearer. FIG. 18 is a perspective view that illustrates shank 14'" for purposes of further showing details of its features. Recess 60' is configured to cooperate with finger pad 40' such that at least one of opposing ends 300 of the finger pad remains received at least partially within recess 60' for any position of the finger pad relative to the shank. In this way, rotation of the finger pad relative to bottom shank 14'" is limited so as to maintain appropriate alignment between the finger pad and bottom shank irrespective of the amount by which support member is extended from the bottom shank. In this regard and as clearly seen in FIG. 18, recess 60' extends upward along the inner periphery of the bottom shank for purposes of receiving one or both ends 300 of the finger pad. It should be appreciated that the features described with regard to FIGS. 16-18 can be used in any embodiment wherein the finger pad is supported for rotation on the support member such as, for example, in an embodiment that uses a key (see FIG. 5 and related descriptions) to rotate the support member to change the position of the finger pad. It is noted that a flare 302 is provided on the free end of post 32, as shown in FIGS. 16 and 17 such that the flare biases against the shank responsive to movement of the post to the raised position to limit further travel of the finger pad.

The embodiments of the adjustable finger ring devices that have been brought to light herein have not been seen heretofore by Applicant. These devices provide for convenient and incremental adjustment while, at the same time, providing for secure retention on the finger of a wearer.

Figure 19:
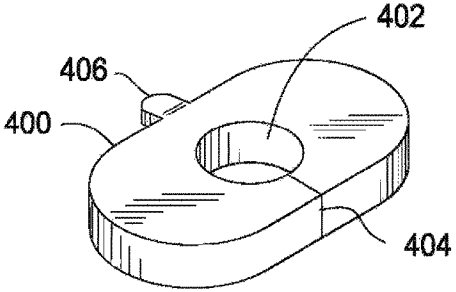
FIG. 19 is a diagrammatic view, in perspective, illustrating an embodiment of a guard or plug for use with embodiments of the present disclosure.

The foregoing description of the invention has been presented for purposes of illustration and description. It is not intended to be exhaustive or to limit the invention to the precise form or forms disclosed. For example, as seen in FIG. 19, a guard or plug 400 can be provided for insertion between the bottom of finger pad 40 and the shank to serve to further support the finger pad and protect the mechanism as well as to limit the possibility of the finger pad catching on other objects. The guard can be provided, for example, with a central aperture 402 for receiving the finger pad support member and a peripheral configuration that is complementary to surrounding features such as, for example, recess 60. Central aperture 402 can readily receive components that are associated with the support member such as, for example, spring 62 of FIG. 1. The central aperture can be configured to conform to the shape of the support member, although this is not required. The outer periphery of the guard can be provided in any suitable shape depending upon an intended application. A side cut 404 to one side of the central aperture can be provided for installation purposes. In an embodiment, a pull tab 406 can be provided. The guard can be formed from any suitable material including but not limited to silicone, rubber, rubber-like and resilient moldable materials. Accordingly, other embodiments, modifications and variations may be possible in light of the above teachings wherein those of skill in the art will recognize certain modifications, permutations, additions and sub-combinations thereof.

What is claimed is:

1. An adjustable finger ring apparatus for forming at least a portion of a finger ring, said apparatus comprising:

a finger pad for engaging a finger of a wearer, the finger pad including a pair of opposing outer ends;

a post having an elongated length extending from said finger pad between the outer ends and the elongated length of the post carries a thread;

a shank including an inner periphery at least partially defining a finger aperture of the finger ring, said shank including a thickness defining a through opening receiving said post such that movement of the post in a first direction moves the finger pad to decrease the size of the finger aperture and movement of the post in a second, opposite direction moves the finger pad to increase the size of the finger aperture and the shank further defines a recess for receiving the finger pad in a retracted position with the shank and the recess being cooperatively configured such that at least one of the opposing ends of the finger pad remains at least partially received within the recess for any position of the finger pad relative to the shank to limit rotation of the finger pad relative to the shank; and a thumbnut received in said recess threadably engaging said post such that selective rotation of the thumbnut moves the post in the first and second directions.

2. The apparatus of claim 1 wherein for at least some positions of the finger pad, a middle portion of the finger pad is outside of the recess when at least one of the opposing ends of the finger pad is partially received in the recess.

3. The apparatus of claim 1 wherein, for at least some positions of the finger pad, a middle portion of the finger pad is outside of the recess when the opposing ends of the finger pad are at least partially received in the recess.

4. The apparatus of claim 1 wherein the recess is a single continuous recess.

5. The apparatus of claim 4 wherein the shank includes at least one side surface defining an access opening for access to the thumbnut for rotation thereof.

6. The apparatus of claim 1 wherein a first end of said post is fixedly attached to the finger pad.

7. An adjustable finger ring apparatus for forming at least a portion of a finger ring, said apparatus comprising:

a finger pad for engaging a finger of a wearer, the finger pad including a pair of opposing outer ends;

a post having an elongated length extending from said finger pad between the outer ends and a first end of said post is fixedly attached to the finger pad;

a shank including an inner periphery at least partially defining a finger aperture of the finger ring, said shank including a thickness defining a through opening receiving said post such that movement of the post in a first direction moves the finger pad to decrease the size of the finger aperture and movement of the post in a second, opposite direction moves the finger pad to increase the size of the finger aperture and the shank further defines a recess for receiving the finger pad in a retracted position with the shank and the recess being cooperatively configured such that at least one of the opposing ends of the finger pad remains at least partially received within the recess for any position of the finger pad relative to the shank to limit rotation of the finger pad relative to the shank wherein a second, opposing end of said post includes a flare such that the flare biases against the shank responsive to sufficient movement of the post in the first direction to limit travel of the post and the finger pad in the first direction.

8. A method comprising:

configuring a finger pad for engaging a finger of a wearer of a finger ring and extending a post having an elongated length, carrying a thread, from the finger pad;

forming a shank to include an inner periphery for at least partially defining a finger aperture of the finger ring, said shank including a thickness;

defining a cavity within the thickness of the shank to include a through opening for receiving the post such that movement of the post in a first direction moves the finger pad to decrease the size of the finger aperture to engage the finger of a wearer and movement of the post in a second, opposite direction moves the finger pad to increase the size of the finger aperture;

defining a recess in the shank for receiving the finger pad in a retracted position, the shank and the recess being cooperatively configured such that at least one of the opposing ends of the finger pad remains at least partially received within the recess for any position of the finger pad relative to the shank to limit rotation of the finger pad relative to the shank; and receiving a thumbnut in the recess threadably engaging the post such that selective rotation of the thumbnut moves the post in the first and second directions.

9. The method of claim 8 further comprising configuring the finger pad and shank such that for at least some positions of the finger pad, a middle portion of the finger pad is outside of the recess when at least one of the opposing ends of the finger pad is at least partially received in the recess.

10. The method of claim 8 including forming the recess as a single continuous recess.

* * * * *